US007944412B2

(12) United States Patent
Ikeda

(10) Patent No.: US 7,944,412 B2
(45) Date of Patent: May 17, 2011

(54) SEMICONDUCTOR DEVICE, DISPLAY APPARATUS, AND DISPLAY APPARATUS DRIVING METHOD

(75) Inventor: Kyoji Ikeda, Gifu (JP)

(73) Assignee: Sanyo Electric Co., Ltd. (JP)

( * ) Notice: Subject to any disclaimer, the term of this patent is extended or adjusted under 35 U.S.C. 154(b) by 904 days.

(21) Appl. No.: 11/183,343

(22) Filed: Jul. 18, 2005

(65) Prior Publication Data

US 2006/0012549 A1 Jan. 19, 2006

(30) Foreign Application Priority Data

Jul. 16, 2004 (JP) ..... 2004-210729
Jul. 7, 2005 (JP) ..... 2005-199419

(51) Int. Cl.
*G09G 3/30* (2006.01)

(52) U.S. Cl. ..... 345/76; 345/55; 345/77; 345/82; 345/92; 315/169.1; 315/169.3

(58) Field of Classification Search ..... 345/76, 345/77, 55, 82, 92; 315/169.3
See application file for complete search history.

(56) References Cited

U.S. PATENT DOCUMENTS 6,943,501 B2 * 9/2005 Kobayashi et al. ..... 315/169.3
7,382,341 B2 * 6/2008 Park ..... 345/77
2003/0189535 A1 * 10/2003 Matsumoto et al. ..... 345/76

FOREIGN PATENT DOCUMENTS

JP 2004-170815 6/2004

OTHER PUBLICATIONS

Japanese Patent Laid-Open Publication No. 2003-173154 with its English abstract.
Notice to Submit Argument corresponding to Korean Patent Application No. 10-2005-64047 mailed Sep. 29, 2006.

* cited by examiner

*Primary Examiner* — Alexander Eisen
*Assistant Examiner* — Viet Pham
(74) *Attorney, Agent, or Firm* — Cantor Colburn LLP

(57) ABSTRACT

Each of pixels arranged in a matrix comprises an element to be driven, a switching TFT, an element driving TFT, and a storage capacitor, and a potential shifting capacitor. The storage capacitor is connected between the gate and a source of the element driving TFT. Before a data signal is output, a precharge signal is output to a data line to turn on the element driving TFT, a set signal is output to a power supply line that is used to supply power through the turned-on element driving TFT to the element to be driven, and, before a data signal is applied to one electrode of the storage capacitor, the source of the element driving TFT and another electrode of the storage capacitor are discharged in response to the set signal to be fixed at a constant potential. By performing control as described above, the element to be driven is driven using a minimum number of circuit elements.

10 Claims, 7 Drawing Sheets

SEMICONDUCTOR DEVICE, DISPLAY APPARATUS, AND DISPLAY APPARATUS DRIVING METHOD

CROSS-REFERENCE TO RELATED APPLICATIONS

The entire disclosure of Japanese Patent Application Nos. 2004-210729 and 2005-199419 including specification, claims, drawings, and abstract is incorporated herein by reference.

BACKGROUND OF THE INVENTION

1. Field of the Invention

The present invention relates to a circuit structure for controlling an element to be driven, such as an electroluminescence display element.

2. Description of the Related Art

Because electroluminescence displays that use a self-emitting electroluminescence (hereinafter, referred to as "EL") element for each pixel as an emissive element are of a self light emitting type, and have advantages such as that the displays are thin and have low power consumption, a great deal of attention has come to be focused on such EL displays, and research is being conducted to use such EL displays as substitutes for displays such as liquid crystal displays (LCDs) or CRTs.

Among various types of EL displays, an active matrix type EL display, in which a switch element such as a thin film transistor (TFT) that individually controls an EL element is provided in each pixel to control an EL element for each pixel, is expected to be useful as a high resolution display.

FIG. 1 shows a circuit structure for one pixel included in an active matrix type EL display having a matrix with n rows and m columns of pixels. This EL display includes a substrate on which a plurality of gate lines GL are formed to extend in the direction of rows, and a plurality of data lines DL and a plurality of driving power supply lines VL are formed to extend in the direction of columns. Each pixel has an organic EL element 50, a switching TFT (first TFT) 10, an EL element driving TFT (second TFT) 21, and a storage capacitor Cs.

The first TFT 10 is connected to a gate line GL and a data line DL. When the gate electrode of the first TFT 10 receives a gate signal (selection signal), the first TFT 10 is turned on, and a data signal supplied to the data line DL is stored in the storage capacitor Cs that is connected between the first TFT 10 and the second TFT 21. A voltage corresponding to the data signal supplied through the first TFT 10 is supplied to the gate electrode of the second TFT 21, and the second TFT 21 is then used to supply a current corresponding to the voltage value from the power supply line VL to the organic EL element 50. The organic EL element 50 emits light when light emitting molecules excited by recombining holes injected from an anode and electrons injected from a cathode in a light emitting layer return from the excited state to the ground state. Because the luminance of an organic EL element 50 is approximately proportional to the current supplied to the organic EL element 50, when, as described above, the current to be fed to a organic EL element 50 is controlled in accordance with a data signal for each pixel, the organic EL element is caused to emit light at a luminance corresponding to the data signal so that a desired image is displayed on the whole display.

In order for an organic EL display to be able to achieve high display quality, it is necessary to cause the organic EL element 50 to emit light reliably at a luminance corresponding to the data signal. Therefore, in an active matrix type EL display, the second TFT 21 provided between the driving power supply line VL and the organic EL element 50 is required to provide a constant drain current even when a current is passed through the organic EL element 50 and varies the potential at the anode of this EL element 50.

Therefore, in many cases, as shown in FIG. 1, the second TFT 21 is formed using a p-ch TFT in which a source is connected to the driving power supply line VL, and a drain is connected to an anode side of the organic EL element 50 so that a current flowing between the source and the drain can be controlled based on a potential difference Vgs between the source and a gate to which a voltage corresponding to a data signal is applied.

However, when a p-ch TFT is used as the second TFT 21, because, as described above, a source is connected to the driving power supply line VL and a drain current, that is, a current to be supplied to the organic EL element 50 is controlled based on a potential difference between the source and a gate, so that there is a high possibility that the emission luminance of each element 50 will vary in response to variations in voltage on the driving power supply line VL.

For example, in cases such as where an image to be displayed in a certain frame period has a high brightness (as an example, where the color of an entire image is white), when a large amount of current is fed to a large number of organic EL elements 50 formed on a substrate at a time through respective driving power supply lines VL from a single driving power supply Pvdd, the potentials on the driving power supply lines VL may vary accordingly. Therefore, in such cases, variations in luminance are likely to occur.

With this being the situation, a pixel circuit wherein an n-ch TFT is used as shown in FIG. 2 to form the second TFT 20 for driving an element is proposed in a commonly assigned Japanese patent application laid open as Japanese Patent Laid-Open Publication No. 2003-173154. In this circuit, the second TFT 20 formed of an n-ch TFT is provided between a power supply line VL and an organic EL element 50, and, in order to hold a potential difference Vgs corresponding to a data signal between a gate and a source of the second TFT 20, a storage capacitor Cs is provided between the gate and the source of the second TFT 20. Further, a reset TFT 30 for resetting (discharging) the potential at the source of the second TFT 20 (the anode of the organic EL element 50) is connected between a low potential power supply Vss and each of the storage capacitor Cs and the source of the second TFT 20. A reset pulse is supplied to the gate of this TFT 30.

In such a structure, the potentials at the first and second electrodes of the storage capacitor Cs, or, in other words, the gate potential and the source potential of the second TFT 20, must be simultaneously set in response to a data signal. Thus, a selection signal having "H" level is output to a selection line GL, a data signal is output to a data line DL, and a reset pulse is output to a reset line RSL to turn on the TFT 30. As a result, the second TFT 20 is put into a state where the potential at the gate is set to a potential corresponding to the data signal, and the potential at the source is decreased to the potential of the power supply Vss. Further, when the first TFT 10 and the third TFT 30 are turned off, the storage capacitor Cs is held at a potential difference corresponding to the data signal. In response to the potential difference held in the storage capacitor Cs, it is possible to supply a current from the power supply line VL through the second TFT 20 to the organic EL element 50.

When a circuit structure as shown in FIG. 2 is used as described above, it is possible to use n-ch TFTs for all transistors formed in the circuit for one pixel. However, in order to set a potential at the source of the second TFT 20, because the third TFT 30 for discharge is also necessary, three transistors must be provided in each pixel. Further, the reset power supply Vss is necessary, and, in addition to the selection line GL, the data line DL, and the power supply line VL, the reset power supply line for supplying power to each pixel from the power supply Vss and the reset line RSL are also necessary. As a result, because the above-described circuit has a limit to how much the area of each pixel can be reduced, it is difficult to incorporate such a circuit into a compact high definition display or the like, such as an EVF (electronic view finder), in which each pixel has a small area.

SUMMARY OF THE INVENTION

The present invention is directed to provide a display that is easy to downsize, and in which power supply to an element to be driven is hardly influenced by fluctuations in voltage of a driving power supply.

According to one aspect of the present invention, there is provided a semi conductor device comprising a switching transistor that operates in response to a selection signal received at a gate of the switching transistor to enable a data signal to transmit through; an element driving transistor having a drain connected to a power supply line, a source connected to an element to be driven, and a gate configured to receive the data signal supplied through the switching transistor, the element driving transistor controlling power to be supplied from the power supply line to the element to be driven; and a storage capacitor that is connected between the gate and the source of the element driving transistor to hold a gate-source voltage corresponding to the data signal, wherein a power supply signal that allows operation of the element to be driven and a set signal for setting a potential at the source of the element driving transistor are periodically applied to the power supply line.

According to another aspect of the present invention, there is provided a display apparatus comprising a plurality of pixels arranged in a matrix, each pixel comprising an element to be driven; a switching transistor that is connected to a selection line and operates in response to a selection signal received at a gate of the switching transistor to enable a data signal to transmit through; an element driving transistor having a drain connected to a power supply line, a source connected to the element to be driven, and a gate configured to receive the data signal supplied from the switching transistor, the element driving transistor controlling power to be supplied from the power supply line to the element to be driven; and a storage capacitor that is connected between the gate and the source of the element driving transistor to hold a voltage corresponding to the data signal, wherein the power supply line is provided independently of an adjacent power supply line for each row or column in the matrix so that a set signal for setting a potential at the source of the element driving transistor can be output for each line.

Further, it is also possible to positively use, in addition to the storage capacitor, a potential shifting capacitor having a first electrode connected to the gate of the element driving transistor, and a second electrode configured such that the selection signal is applied to the second electrode, the potential shifting capacitor shifting a potential at the gate of the element driving transistor in accordance with a level of the selection signal.

As described above, by employing a structure as described above to form circuit elements for controlling an element to be driven, it is possible to minimize the area of these circuit elements that usually cannot be used as a display area within one pixel area. Further, by providing a power supply line that can be controlled independently for each row or column in a matrix, it is possible to form two transistors using n-channel type thin film transistors, and it is also possible to apply a data signal to a gate of an element driving transistor after the potential of a source of this element driving transistor, which is connected to the element to be driven, (the potential of one electrode of a storage capacitor) is set to a sufficiently low potential. Therefore, the storage capacitor (between the gate and the source of the element driving transistor) can be charged in response to a data signal, and can be reliably held in the charged state.

According to still another aspect of the present invention, there is provided a driving method for a display apparatus that performs display by driving an element to be driven in each pixel, the method comprising the steps of, before a data signal corresponding to a content to be displayed is output to a data line, setting the data line to a predetermined precharge potential; causing the power supply line to have a set potential for setting the source of the element driving transistor to a non-operational potential for the element to be driven; and outputting a selection signal to the selection line to control the switching transistor to be turned on to thereby cause the element driving transistor to operate; and after the source of the element driving transistor is set to a non-operational potential for the element to be driven through the power supply line, outputting a data signal to the data line.

According to still another aspect of the present invention, it is preferable that, in the above-described driving method, after the selection signal output to the selection line is caused to fall to turn off the switching transistor, and a potential shifting capacitor provided between the gate of the element driving transistor and the gate line shifts a potential at the gate of the element driving transistor toward a direction to turn off the element driving transistor, the power supply line is caused to rise to an operational potential for the element to be driven, and the element driving transistor supplies power from the power supply line to the element to be driven in accordance with a potential difference set at the storage capacitor.

According to the present invention, an element to be driven can be reliably driven using a minimum number of circuit elements and wires. Therefore, the area occupied by circuit elements and the like in one pixel area can be minimized, and, even for use in a compact display or a high resolution display, in which each pixel has a small area, it is easy to achieve a display accomplishing a high aperture ratio and having an excellent display quality.

Further, because all transistors can be formed using the same type of transistors, such as n-channel type transistors, and all transistors included in one pixel circuit can be formed in the same process, it is possible to reduce the number of processes. As a result, the present invention is also effective in reducing variations in characteristics.

DESCRIPTION OF PREFERRED EMBODIMENT

A preferred embodiment (hereinafter, referred to as an "embodiment") of the present invention will be described with reference to the drawings.

Figure 1:
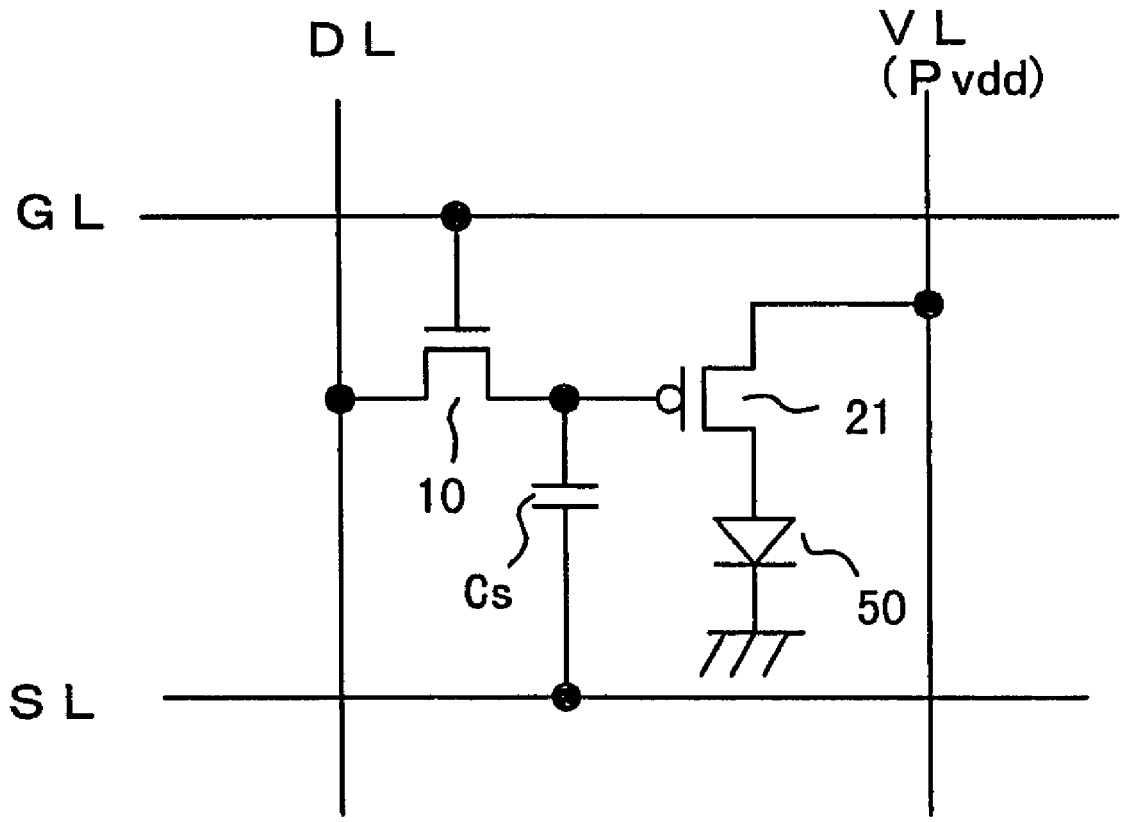
Fig. 1 PRIOR ART
FIG. 1 shows a circuit structure of a conventional active matrix type organic EL display.
Figure 2:
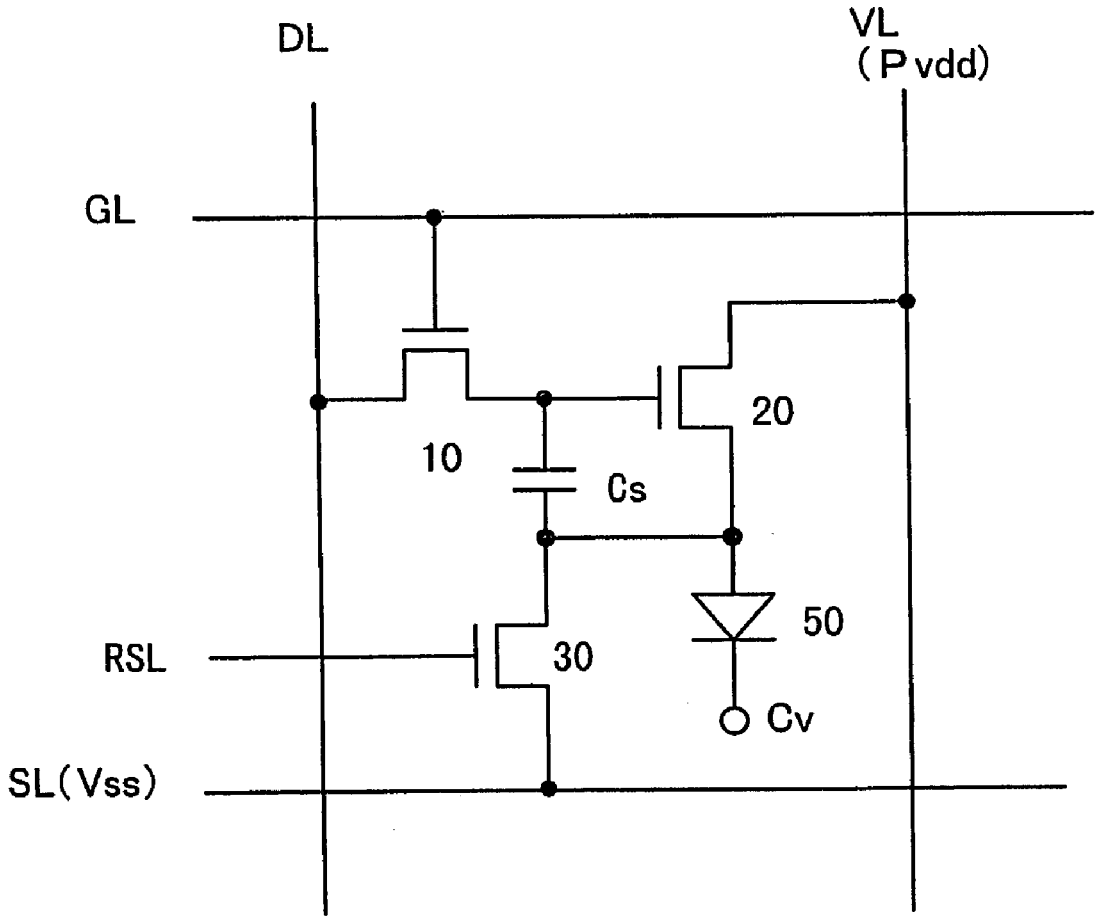
Fig. 2 PRIOR ART
FIG. 2 shows another circuit structure of a conventional active matrix type organic EL display.
Figure 3:
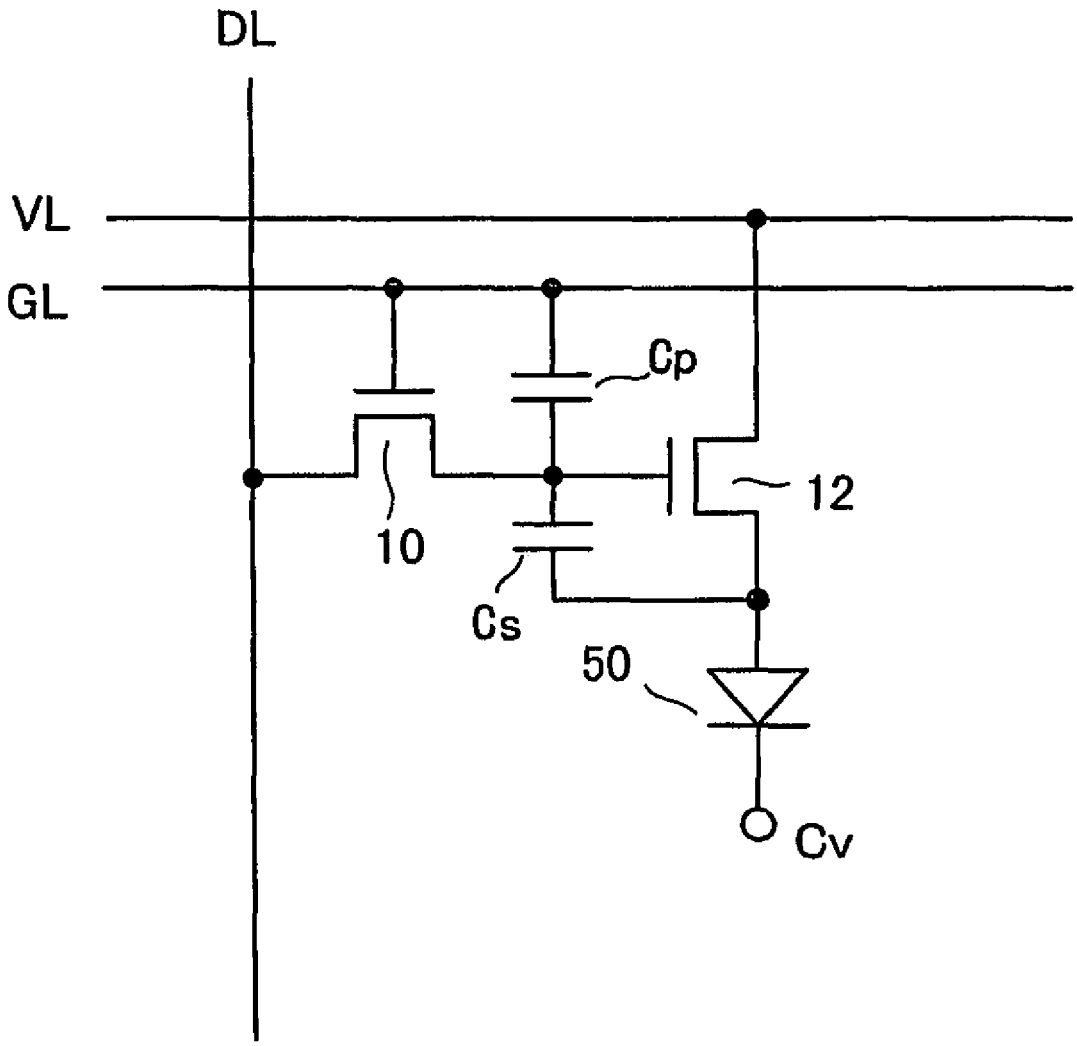
FIG. 3 shows a circuit structure for one pixel for driving an organic EL element according to a preferred embodiment of the present invention.
Figure 4:
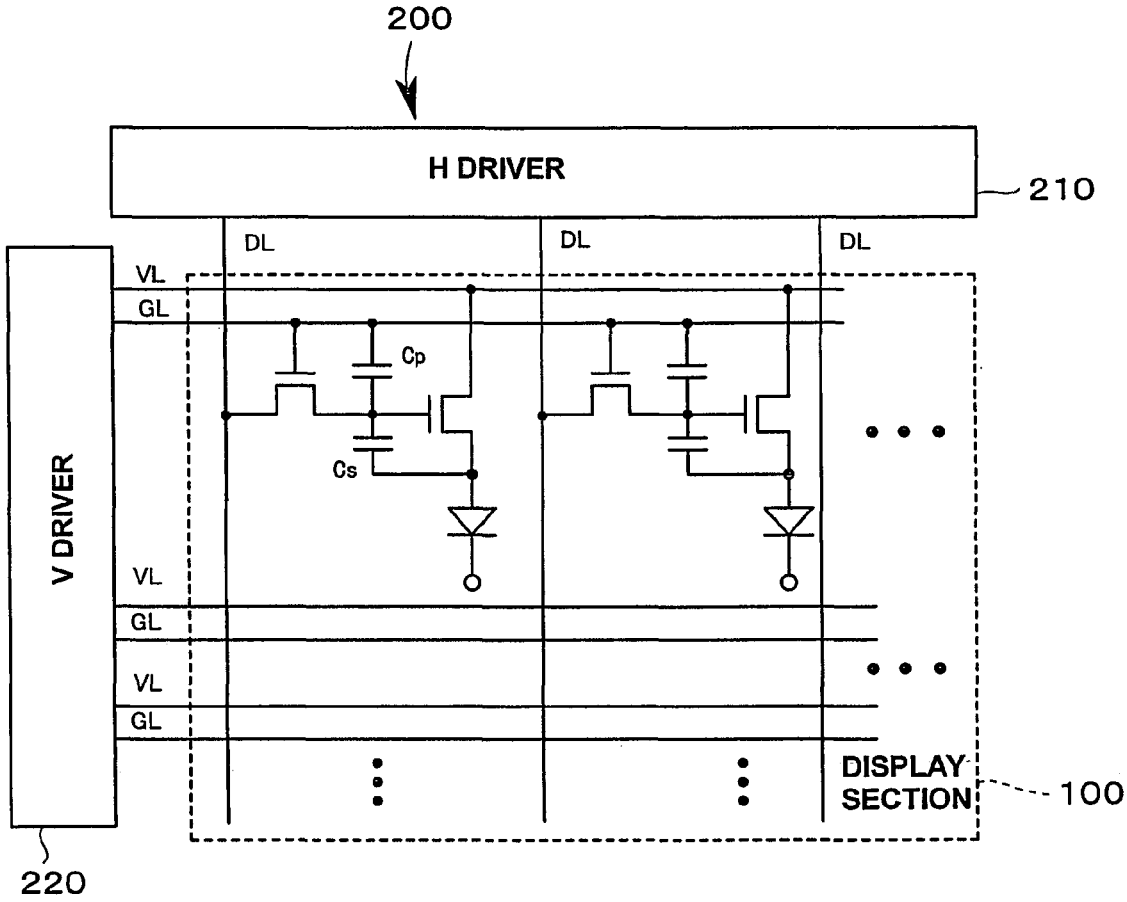
FIG. 4 shows a circuit structure of an active matrix type organic EL display according to a preferred embodiment of the present invention.

FIG. 3 shows a circuit structure for one unit of a semiconductor device according to the embodiment of the present invention, and FIG. 4 is a schematic diagram showing an overall structure of a display in which the circuit structure shown in FIG. 3 is used for each pixel. Specifically, the display used in this embodiment is an active matrix type organic EL display that has a plurality of pixels arranged in the form of a matrix on a panel substrate. On this panel substrate, selection lines GL and power supply lines VL are formed in the direction of rows in the matrix, and data lines DL are formed in the direction of columns in the matrix. A selection signal is sequentially output to a selection line GL, a power supply line VL is used to periodically supply operating power (Pvdd) to an element to be driven, and a data signal is output to a data line DL.

Each pixel is generally provided in an area defined by these lines, and includes an organic EL element 50 as an element to be driven, and also includes, as two transistors for controlling light emission operation of this element, a switching thin film transistor (first TFT) 10 and an element driving thin film transistor (second TFT) 12, which are each formed using an n-ch TFT. Further, each pixel includes a storage capacitor Cs for holding a voltage corresponding to a data signal, and a potential shifting capacitor Cp for shifting the potential at the gate of the second TFT 12.

Each of the first TFT 10 and the second TFT 12 may be formed of an n-channel type thin film transistor having an active layer that is formed using a crystal line silicon, such as a polycrystalline silicon polycrystallized by laser annealing or the like, and is doped with an n-conductive type impurity. Thus, because these two TFTs are of the same conductivity type, it is possible to form these TFTs through the same process (at least, through the same impurity doping process).

The first TFT 10 has a gate connected to a selection line GL, and a drain connected to a data line DL. When the gate receives a selection signal, the first TFT 10 is turned on, and a source thereof is set to a potential corresponding to the potential of the data line DL.

The second TFT 12 has a drain connected to a power supply line VL, and a source connected to an anode side of the organic EL element 50. Further, the second TFT 12 has a gate connected to the source of the first TFT 10, the storage capacitor Cs, and the potential shifting capacitor Cp.

The storage capacitor Cs is connected between the gate and the source of the second TFT 12 to hold a gate-source voltage in accordance with a data signal. More specifically, the storage capacitor Cs has a first electrode connected to the gate of the second TFT 12, and a second electrode connected to the source of the second TFT 12 (and the anode of the organic EL element 50), so that the storage capacitor Cs holds a voltage (Vsig) corresponding to a data signal between the first and second electrodes.

The potential shifting capacitor Cp is connected between the gate of the second TFT 12 and the selection line GL so that the potential at the gate of the second TFT 12 is decreased in response to falling of a selection signal. More specifically, the potential shifting capacitor Cp has a first electrode connected to the selection line GL, and a second electrode connected to the gate of the second TFT 12 and the first electrode of the storage capacitor Cs.

As shown in FIG. 4, a display section 100 and a driver section 200 are provided on a panel substrate. The display section 100 includes a plurality of pixels arranged in a matrix, in which each pixel has a structure as described above. The driver section 200 is provided at periphery of the display section 100, and outputs a drive signal and power for driving each of the pixels included in the display section 100. More specifically, the driver section 200 includes an H driver (horizontal driver) 210, and a V driver (vertical driver) 220. The H driver 210 outputs a corresponding data signal and a precharge signal, which will be described below, to each of the plurality of data lines DL extending in the direction of columns of the matrix. The V driver 220 includes an output section to sequentially output a selection signal to each of the plurality of selection lines GL extending in the direction of rows of the matrix. The selection signal is output in each horizontal scanning signal, so that in response to the selection, the first TFT 10 is turned on. In addition, according to the present embodiment, the V driver 220 includes an output section to output a power supply signal and a set signal to each of the power supply lines VL that are provided in parallel with the respective selection lines GL in the direction of rows of the matrix. The power supply signal is output during a period of light emission operation of an organic EL element, and has a potential (Pvdd) to operate the organic EL element. The set signal is output during a period of data setting in one horizontal scanning period preceding the period of light emission operation, and has a low constant potential (for example, 0V) to discharge the anode of the organic EL element 50 and the source of the second TFT 12 so that the potential at the anode of the organic EL element 50 is set to a non-operational potential.

Figure 5:
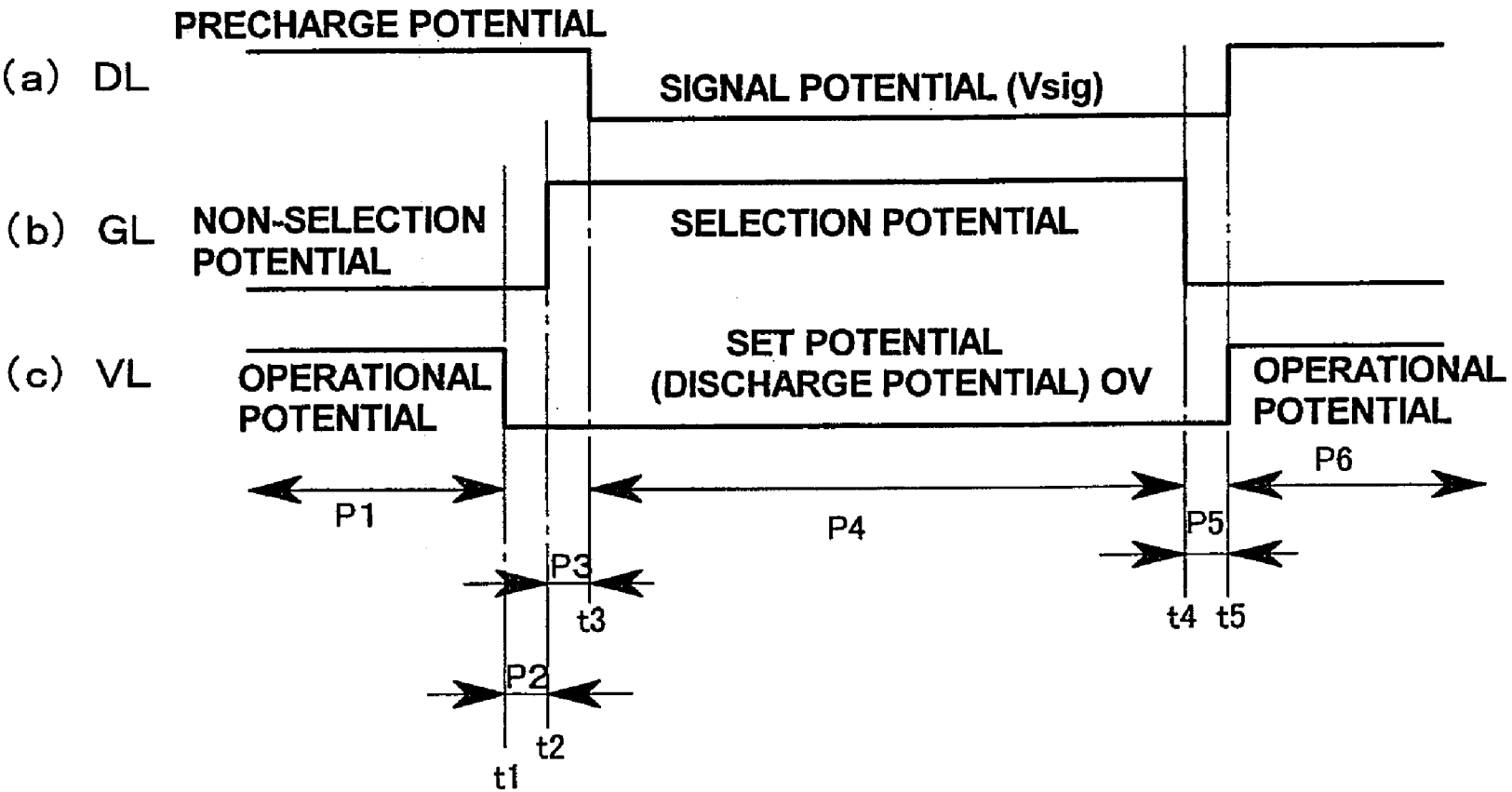
FIG. 5 is a timing chart showing operation of the circuit shown in FIG. 3.

Next, a driving method for a circuit structure as described above and operation thereof will be described in more detail with reference to FIG. 5. FIG. 5 is a chart for illustrating operation timing for one pixel within one horizontal scanning period.

According to the present embodiment, a precharge signal having a high potential is output to a data line DL for a corresponding pixel as shown by FIG. 5(*a*) during a period P1 before time t2 at which a selection signal shown by FIG. 5(*b*) changes from a non-selection potential ("L" level) to a selection potential ("H" level).

At time t1, as shown by FIG. 5(*c*), a set signal is output to a power supply line VL. Specifically, the potential is decreased from a high operational potential (power supply signal level) of, for example, 9V to a low set potential of, for example, 0V, which is similar to that of the cathode of the EL element 50. As a result, the power supply line VL is discharged during a period P2.

When time t2 is reached, the selection signal rises from a non-selection potential to a selection potential, and the first TFT 10 is turned on. As described, when the selection signal changes to "H" level to turn on the first TFT 10 (that is, at time t2), a precharge signal is already output to the data line DL. This precharge signal has a potential that is sufficiently high to turn the second TFT 12 into a "full on" state (an "on" operation in a triode region, or, in other words, in a linear region). More specifically, the potential is high enough to enable operation with a constant drain current Id regardless of a source-drain voltage VSD.

Thus, during a period P3, the precharge signal is applied through between the drain and the source of the first TFT 10 to the gate of the second TFT 12 to turn on the second TFT 12. At this time, a set signal having "L" level is output to the power supply line VL.

As a result, the source of the turned-on second TFT 12 is discharged between the drain and the source of the second TFT 12 to have a low potential (for example, 0V) equal to that of the set signal. As described above, the source of the second TFT 12 is connected to the anode of the organic EL element 50, and the potential of the set signal is set to "L" level at which the organic EL element 50 having a diode structure does not operate. Therefore, regardless of how the organic EL element 50 operates until then (such as whether the element is turned on or off, and the amount of current flowing through the element), electric charges are discharged from the anode of the organic EL element 50 (the source of the second TFT 12) through the second TFT 12, and the organic EL element 50 is turned into a non-operational state. Further, because the source of the second TFT 12 is connected to the second electrode of the storage capacitor Cs, the potential at the second electrode of the storage capacitor Cs (the potential at the source of the second TFT) is fixed to a set potential corresponding to the set signal.

Because the first electrode of the storage capacitor Cs is connected to the gate of the second TFT 12, and the first TFT 10 is turned on during a period when the selection signal has "H" level, the precharge signal having a constant potential is applied to the first electrode of the storage capacitor Cs through the data line DL. As a result, the storage capacitor Cs is preset to have electric charges corresponding to the potential difference between the precharge signal and the set signal.

After the storage capacitor Cs is preset, when predetermined time t3 is reached, a data signal (Vsig) corresponding to an actual content to be displayed is output to the data line DL. Then, during a data writing period P4 from time t3 to time t4, this data signal (Vsig) is applied to the first electrode of the storage capacitor Cs whose second electrode is fixed at the set potential, and the storage capacitor Cs holds a voltage corresponding to the data signal.

After completion of the period P4, at time t4, the selection signal falls from "H" level to "L" level to turn off the first TFT 10, and writing of the voltage corresponding to the data signal to the storage capacitor Cs (setting of Vsig) is completed.

After, at time t4, the selection signal is caused to fall to the non-selection level to turnoff the first TFT 10, a predetermined time of period P5 is provided to allow for delays in receiving (transmitting) data, or, in other words, to reliably receive data, before the first TFT 10 is turned off. After expiration of this period P5, at time t5, the precharge signal is output to the data line DL, as shown by FIG. 5(*a*). In other words, the potential is changed from the data signal potential (Vsig) to the precharge potential. In addition, the power supply signal on the power supply line VL is caused to rise from the set potential to the "H" level operational potential. Thus, while the storage capacitor Cs continues to hold the voltage Vgs, the power supply line VL switches to the operational potential, and a current flows between the drain and the source of the second TFT 12 from the power supply line VL in accordance with the held voltage Vgs so that this current is supplied to the anode of the organic EL element 50. Because, as described, a current corresponding to the data voltage held by the storage capacitor Cs (the gate-source voltage of the second TFT 12) flows into the organic EL element 50 until the pixel is again selected for the next field, the organic EL element 50 continues to emit light at a luminance corresponding to the amount of current.

In this structure, because the potential shifting capacitor Cp is connected between the gate of the second TFT 12 and the selection line GL for supplying the selection signal to this pixel, when the selection signal falls to "L" level at time t4, in response to that, the capacitor Cp operates to cause the potential at the gate of the second TFT 12 to be decreased. For example, when a content to be displayed is "black" and the second TFT 12 is to be turned off to put the organic EL element 50 into a non-emission state, it is sufficient for the storage capacitor Cs to have a storage potential difference less than an operational threshold of the second TFT 12. Although, during a precharge period, the second TFT 12 is turned full on, it is possible to cut off the second TFT 12 more quickly because the potential at the gate of the second TFT 12 can be shifted toward a lower potential at the time of falling of the selection signal. As a result, it is possible to achieve a black level quickly and reliably.

It is to be noted that the potential shifting capacitor Cp can be formed using a so-called parasitic capacitor formed between the gate and the drain of the second TFT 12. Further, it is to be understood that a separate capacitor electrically connected in parallel with this parasitic capacitor may be formed in addition to the parasitic capacitor. The capacitance value of this parasitic capacitor is not "0", and the capacitance ratio "rc" of the potential shifting capacitor Cp and the storage capacitor Cs (rc=Cp/Cs) is greater than 0 (0<rc). In order to allow the potential shifting capacitor Cp to perform the shifting function sufficiently, the capacitance ratio "rc" is set to be equal to or greater than 0.3, and, for example, is set to approximately 0.3, or set to approximately 0.5.

Figure 6:
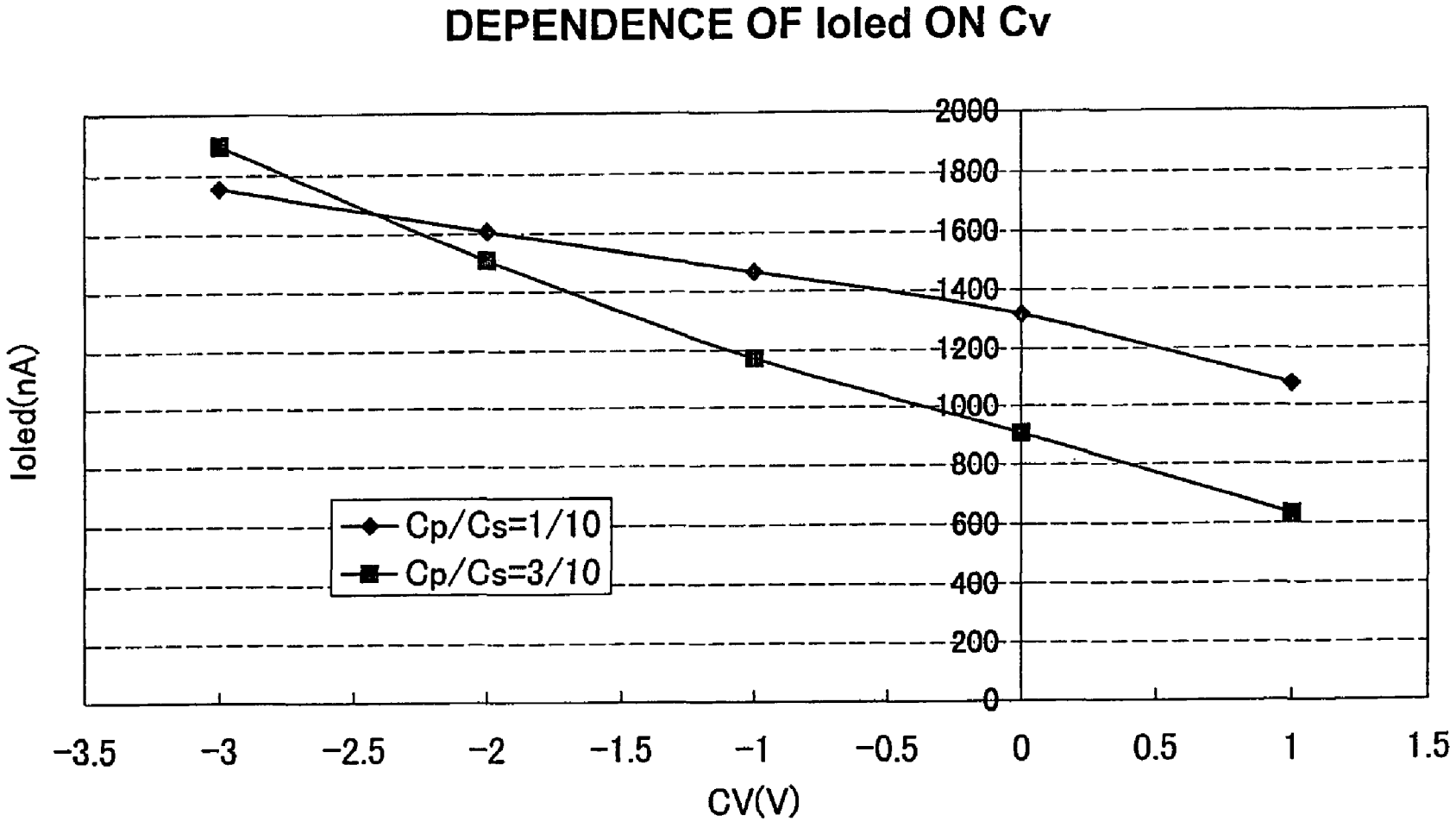
FIG. 6 shows Cv-Ioled characteristics of Cp/Cs.

When the black level potential of a data signal is limited, that is, when the black level potential cannot be lowered to an extent equal to or greater than a certain extent because of an operational range or other requirements of a data signal processing side circuit, it is preferable for the capacitance of the potential shifting capacitor Cp to be increased so that, as described above, the capacitance ratio "rc" becomes equal to or greater than approximately 0.3, and, for example, becomes 0.5. On the other hand, when the black level potential of a data signal can be lowered, or when the lifespan of an EL element is of concern, as will be described below, it is preferable for the capacitance of the potential shifting capacitor Cp to be decreased, and is set, for example, so that the capacitance ratio "rc" becomes approximately 0.1. When the capacitance ratio "rc" is adjusted to be approximately 0.1, although the shifting function of the potential shifting capacitor Cp becomes extremely small, by lowering the black level potential of a data signal, it is possible to achieve a black level quickly and reliably. Although, it is possible to reliably cut off the second TFT 12 at time t4 when the potential shifting capacitor Cp has a large capacitance, when the cathode voltage Cv of an EL element is relatively lower than that of a selection signal, because the potential shifting capacitor Cp is provided, the gate of the second TFT 12 has a potential that is relatively higher than the cathode voltage Cv (in particular, during a period when the selection signal has "H" level), and the amount of current flowing into the EL element 50 tends to increase. FIG. 6 shows changes in characteristics of the cathode voltage Cv and the current (operating current) Ioled flowing into an EL element in a case where Cp/Cs (=rc) is set to 1/10, and in a case where Cp/Cs (=rc) is set to 3/10, respectively, with respect to the characteristics of the current Ioled that flows into the EL element when the cathode voltage Cv is changed. As shown in FIG. 6, when the cathode voltage Cv becomes low, the change in the operating current Ioled in response to the change in the cathode voltage Cv in the case where Cp/Cs is 3/10 is greater than that in the case where Cp/Cs is 1/10. For example, an EL element that changes its characteristics with time can therefore change its operational threshold, and the change in operational threshold of an EL element can be considered to be equivalent to the change in the cathode voltage Cv shown in FIG. 6 with respect to the gate of the second TFT 12. In other words, as can be seen from FIG. 6, when the operational threshold of an EL element is changed, the change in the driving current Ioled becomes greater. When the extending of the lifespan of the EL element 50 is of great importance, because the deterioration of the EL element 50 is accelerated as the amount of supplied current is increased, it is desired that the change in the driving current Ioled in response to the change in the cathode voltage Cv is small, and it is preferable to decrease the capacitance of the potential shifting capacitor Cp.

Next, overall operation of a display that sequentially drives a plurality of pixels to cause each element to emit light will be described with reference to FIG. 7.

The pixels in each row operate as described above, in which, before the "H" level selection signal is output to the 1st row selection line GL, the precharge signal is output to each data line DL, and the set signal is output to the 1st row power supply line VL. Subsequently, the data signal having a potential corresponding to a content to be displayed by a 1st row pixel is output to a data line DL (as an example, FIG. 7 shows the m-th column data line DL) to cause the storage capacitor Cs to hold a voltage corresponding to the data signal. Then, after the selection signal for the 1st row selection line GL is turned to "L" level, the data line DL is turned to the precharge potential, and, at the same time, the 1st row power supply line VL is turned to the "H" level operational potential. In this example embodiment, one horizontal scanning period (1H period) corresponds to a period from when a data line DL is turned to the precharge potential until the data line DL is again turned to the precharge potential. Although, for purposes of illustration, the precharge period shown in this chart occupies a relatively long period in the 1H period, the precharge period may in practice be a short period in the order of, for example, a horizontal blanking period. The precharge period is set such that the data signal Vsig can be written to the storage capacitor Cs sufficiently in a period obtained by subtracting the precharge period from 1H period.

In this embodiment, after a horizontal scanning period for the 1st row is completed, the 1st row selection line GL has the non-selection potential until the 1st row selection line GL is again selected in the next field. On the other hand, the 1st row power supply line VL maintains the "H" level operational potential to be able to keep the EL element emitting light for a period from completion of the horizontal scanning period for the 1st row until the 1st row is again selected in the next field.

Figure 7:
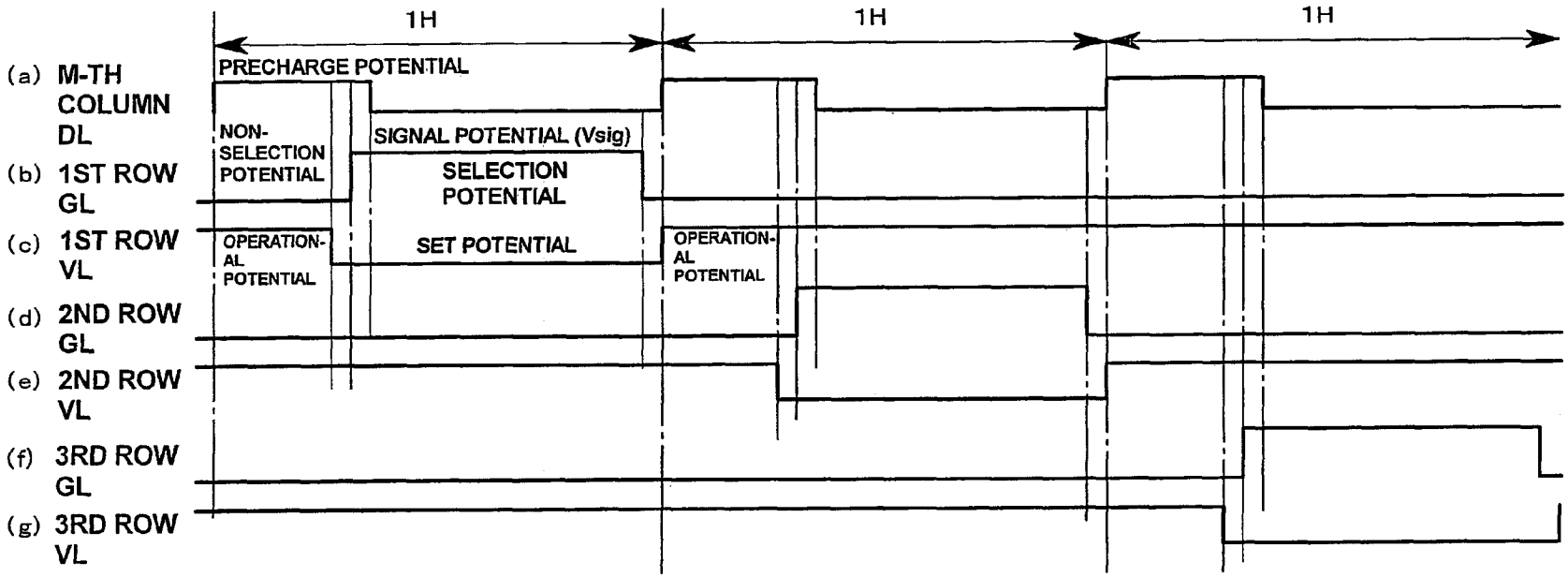
FIG. 7 is a timing chart showing overall operation of an organic EL display according to a preferred embodiment of the present invention.

After the horizontal scanning period for the 1st row is completed, when a horizontal scanning period for the 2nd row starts, first, the data line DL is again turned to the precharge potential as shown by FIG. 7(*a*), and the "L" level set signal is output to the 2nd row power supply line VL as shown by FIG. 7(*e*). After that, the "H" level selection signal is output to the 2nd row selection line GL as shown by FIG. 7(*d*) so that the source of the second TFT 12 (the anode of the organic EL element 50) in a 2nd row pixel is discharged. Next, instead of the precharge potential, the data signal having a potential corresponding to a content to be displayed by each pixel in the 2nd row is output to the data line DL as shown by FIG. 7(*a*) to be written to the storage capacitor Cs in the 2nd row pixel. After the 2nd row selection line GL is turned to "L" level and writing is completed, the data line DL rises to the precharge potential, and the 2nd row power supply line VL is turned to the operational potential. At this point in time, the 2nd horizontal scanning period is completed.

Likewise, during the subsequent horizontal scanning period for the 3rd row, as for the above-described 1st row and 2nd row, the data line DL, the 3rd row power supply line VL (refer to FIG. 7(*g*)), and the 3rd row selection line GL (refer to FIG. 7(*f*)) are controlled so that the data line DL is precharged, the power supply line VL is switched to the set potential (the line VL is discharged), the source of the second TFT is discharged, the storage capacitor is precharged, data is written, the first TFT is controlled off, and the organic EL element 50 starts to emit light (the power supply line VL rises to the operational potential). From then on, similar driving operation is repeated until the n-th row in the matrix with m columns and n rows to write and display data for one field so that light emission for display of a desired image is achieved.

As described above, according to the present embodiment, the power supply line VL is controlled for each row. However, the present invention is not limited to such an embodiment, but, for example, the power supply signal and the set signal to be periodically output to the power supply line VL may be generated using various types of signals, such as a vertical start pulse STV, a vertical shift clock CKV, and an enable signal for prohibiting output of data in each horizontal blanking period or the like, through the combined use of a logic gate, an inverter, and the like in the V driver 220 that sequentially outputs the selection signal. Alternatively, a display control driver IC or the like provided outside the panel may be used to generate the power supply signal and the set signal to output these signals through the V driver 220.

The potentials of the respective signals may be as follows, for example: the power supply signal may have an operational potential of 7V and a set potential of 0V, and the data signal may have a precharge potential of 7V and a minimum signal potential (black potential) of 1V. Further, the selection signal in this example has a potential difference between the non-selection potential and the selection potential that is set such that the gate-source potential difference Vgs of the first TFT 10 is always sufficiently greater than an operational threshold of this TFT, and may be set to, for example, 12.5V (a difference between 8.5V and −4V). The organic EL element 50 may have a cathode potential Cv of, for example, approximately −3V to −2V. By setting the potentials of the respective signals and the potential difference to have a relationship as described above, and by outputting the signals with timing as described above, it is possible to reliably drive the pixel circuit according to the present embodiment.

Further, the present invention is not limited to a structure wherein the power supply line VL is controlled for each row, but a common power supply line may be provided in the direction of columns. However, when a power supply line is used in common for each column, the above-described driving method as shown in FIGS. 5 and 7 is not employed, and a period of one field is provided to include a period (address period) during which each pixel is sequentially selected for data to be written to, and a subsequent element light emission period. Further, it is preferable that data is written after all power supply lines VL are turned to the set potential before the address period, and the potential is controlled to rise to the operational potential during the element light emission period. Such a driving method may also be employed in a circuit structure wherein a power supply line VL is connected in common in the direction of rows as in the above-described embodiment.

As described above, according to the above-described embodiment, even when a current flows into the organic EL element 50 during a period of light emission of the element to cause the potential at the source of the second TFT 12 to rise, the function of the storage capacitor Cs allows a current corresponding to the data signal (Vsig) to be stably supplied to the organic EL element 50. Further, because an n-ch TFT is used for the second TFT 12, it is possible to use a data signal having the same polarity as a video signal.

Further, during a period of writing of a data signal to the storage capacitor Cs, by outputting a sufficiently low constant potential set signal to the power supply line VL, it is possible to reliably write the data signal to the storage capacitor Cs.

The first and second TFTs 10 and 12 both configured to be of an n-channel type in the above-described embodiment may be formed each using a so-called LD structure wherein a low concentration impurity doped region is provided between the channel and the source and drain. Further, both the first and second TFTs 10 and 12 may be formed using a so-called double gate structure where in a plurality of channel regions are provided in series with a carrier transport path between the source and drain. In particular, in order to prevent leakage of a data signal written to the storage capacitor Cs, it is preferable that the first TFT 10 is formed to have a double gate structure.

Typically, because a bottom emission type display emits light emitted from an organic EL element from a panel substrate (element substrate) side on which the organic EL element is formed, a large number of light-shielding circuit elements will inevitably result in a reduced area of light emission. However, when the display according to the above-described embodiment is applied as this bottom emission type display, because an organic EL element can be driven simply using two transistors and two capacitors for one pixel, it is possible to minimize the number of circuit elements and the number of wires in one pixel region. As a result, it is possible to maximize the area of light emission in one pixel region so that a display having a high aperture ratio can be achieved. Thus, the display according to the above-described embodiment is very advantageous for use as a panel, such as a viewfinder for a digital still camera, a compact video camera, or the like, that is required to be compact and high resolution, and in which one pixel has a small area. In such cases, because the display is used as a compact panel, the absolute length of wire can be short, and, even when the potential of the power supply line VL is controlled in a so-called "on/off" manner, the waveform rounding resulting therefrom can be minimized. As a result, it is possible to achieve a compact, high resolution, high aperture ratio display without a reduction in display quality through the use of a minimum number of pixel circuit elements having a small number of wires. Further, the display according to the above-described embodiment may also be used in a top emission type in which light is emitted to the outside from a side opposite to the panel substrate. Also in this case, it is possible to form two TFTs efficiently through the same process, and a compact high definition display having small variations in luminance can be achieved.

What is claimed is:

1. A semiconductor device, comprising:

an element to be driven comprising an organic EL element;

a power supply line;

a switching transistor that operates in response to a selection signal received at a gate of the switching transistor to enable a data signal to transmit through, the switching transistor being formed of an n-channel thin film transistor;

an element driving transistor having a drain connected to the power supply line, a source connected to an anode of the organic EL element, and a gate configured to receive the data signal supplied through the switching transistor, the element driving transistor controlling power to be supplied from the power supply line to the element to be driven, and being formed of an n-channel thin film transistor;

a storage capacitor having one electrode connected between the element to be driven and the source of the element driving transistor, and the other electrode connected to the gate of the element driving transistor, to hold a gate-source voltage corresponding to the data signal;

a pixel having the element to be driven, the switching transistor, the element driving transistor, and the storage capacitor;

a first signal output section that periodically applies, to the power supply line, a power supply signal that allows operation of the element to be driven of the one pixel, and a set signal for setting a potential at the source of the element driving transistor of the one pixel to a non-operational potential of the element to be driven of the one pixel at least during a period in which the switching transistor of the one pixel operates in response to the selection signal; and a second signal output section that supplies a precharge signal, for placing the element driving transistor of the one pixel into an operational state, to the switching transistor of the one pixel, before the data signal is supplied to the switching transistor of the one pixel, during the period in which the switching transistor of the one pixel operates in response to the selection signal;

wherein the power supply signal and the set signal have different voltages.

2. A semiconductor device according to claim 1, wherein the switching transistor and the element driving transistor are both n-channel type thin film transistors, each having an active layer that uses a crystalline silicon.

3. A semiconductor device according to claim 1, further comprising a potential shifting capacitor having a first electrode connected to the gate of the element driving transistor, and a second electrode configured such that the selection signal is applied to the second electrode, the potential shifting capacitor shifting a potential at the gate of the element driving transistor in accordance with a level of the selection signal.

4. A display apparatus, comprising a plurality of pixels arranged in a matrix, each pixel comprising:

an element to be driven comprising an organic EL element;

a power supply line;

a switching transistor that is connected to a selection line and operates in response to a selection signal received at a gate of the switching transistor to enable a data signal to transmit through, the switching transistor being formed of an n-channel thin film transistor;

an element driving transistor having a drain connected to the power supply line, a source connected to an anode of the organic EL element, and a gate configured to receive the data signal supplied through the switching transistor, the element driving transistor controlling power to be supplied from the power supply line to the element to be driven and being formed of an n-channel thin film transistor;

a storage capacitor having one electrode connected between the element to be driven and the source of the element driving transistor, and the other electrode connected to the gate of the element driving transistor, to hold a voltage corresponding to the data signal; and a first signal output section that periodically applies, to the power supply line, a power supply signal that allows operation of the element to be driven of one pixel, and a set signal for setting a potential at the source of the element driving transistor of the one pixel to a non-operational potential of the element to be driven of the one pixel at least during a period in which the switching transistor of the one pixel operates in response to the selection signal;

wherein the power supply line is provided independently of an adjacent power supply line for each row or column in the matrix so that a set signal for setting a potential at the source of the element driving transistor can be output for each line; and the power supply signal and the set signal have different voltages.

5. A display apparatus according to claim 4, wherein a display section having the plurality of pixels arranged in the matrix and a driver section for controlling operation of each pixel of the display section are provided on a substrate, wherein the driver section is provided at periphery of the display section, the driver section comprising:

a selection signal output section that outputs a selection signal to the selection line;

a data signal output section that outputs a data signal to a data line; and an output section that outputs, to the power supply line, the set signal and a power supply signal that allows operation of the element to be driven.

6. A display apparatus according to claim 4, wherein the switching transistor and the element driving transistor are both n-channel type thin film transistors, each having an active layer that uses a crystalline silicon.

7. A display apparatus according to claim 4, wherein:

the selection line and the power supply line are arranged in a direction of rows of the matrix for each row; and a data line that supplies a data signal to the switching transistor corresponding to the data line is arranged in a direction of columns of the matrix for each column.

8. A display apparatus according to claim 4, wherein each of the pixels further comprises a potential shifting capacitor that is connected between the gate of the element driving transistor and the selection line to shift a potential at the gate of the element driving transistor in accordance with a level of a supplied selection signal.

9. A display apparatus driving method for driving a display, the display comprising a plurality of pixels arranged in a matrix, each pixel comprising:

an element to be driven comprising an organic EL element;

a power supply line;

a switching transistor having a gate connected to a selection line, and a drain connected to a data line;

an element driving transistor having a drain connected to the power supply line, a source connected to an anode of the organic EL element, and a gate connected to a source of the switching transistor, the element driving transistor controlling power to be supplied from the power supply line to the element to be driven; and a storage capacitor connected between the gate and the source of the element driving transistor, the method comprising:

setting the data line corresponding to one pixel to a predetermined precharge potential;

causing the power supply line corresponding to the one pixel to have a set potential for setting the source of the element driving transistor of the one pixel to a non-operational potential for the element to be driven of the one pixel; and outputting a data signal to the data line corresponding to the one pixel after a selection signal is output to the selection line corresponding to the one pixel to control the switching transistor of the one pixel to be turned on to thereby cause the element driving transistor of the one pixel to operate; and wherein, when setting the data line, the setting the data line to the precharge potential, the causing the power supply line to have a set potential, and the outputting the selection signal are performed before the data signal is output, and wherein, when setting the data line, the causing the power supply line to have the set potential for setting, through the power supply line, the source of the element driving transistor, which operates by the precharge potential, to a non-operational potential for the element to be driven, and the outputting the data signal to the data line are performed during a period in which the switching transistor operates in response to the selection signal;

wherein each of the pixels further comprises a potential shifting capacitor connected between the selection line and the gate of the element driving transistor, wherein after the selection signal output to the selection line is caused to fall to turn off the switching transistor, and the potential shifting capacitor shifts a potential at the gate of the element driving transistor toward a direction to turn off the element driving transistor, the power supply line is caused to rise to an operational potential for the element to be driven, and the element driving transistor supplies power from the power supply line to the element to be driven in accordance with a potential difference set at the storage capacitor; and wherein the operational potential and the set potential have different voltages.

10. A display apparatus driving method according to claim 9, wherein the precharge potential is set at a potential capable of causing the element driving transistor to operate in a linear region thereof.

* * * * *